US005762358A

United States Patent [19]

Hale

[11] Patent Number: 5,762,358

[45] Date of Patent: Jun. 9, 1998

[54] SWIVELABLE BINDINGS MOUNT FOR A SNOWBOARD

[76] Inventor: Joseph P. Hale, 3003 Arapahoe St., Denver, Colo. 80205

[21] Appl. No.: 668,721

[22] Filed: Jun. 24, 1996

[51] Int. Cl.[6] ..... A63C 5/00

[52] U.S. Cl. ..... 280/607; 280/618

[58] Field of Search ..... 280/607, 618, 280/14.2, 633, 617

[56] References Cited

U.S. PATENT DOCUMENTS

| | | | |
|---|---|---|---|
| 5,028,068 | 7/1991 | Donovan | 280/618 |
| 5,354,088 | 10/1994 | Vetter et al. | 280/618 |
| 5,499,837 | 3/1996 | Hale et al. | 280/607 |
| 5,553,883 | 9/1996 | Erb | 280/607 |
| 5,577,755 | 11/1996 | Metzger et al. | 280/607 |

*Primary Examiner*—Peter M. Poon
*Attorney, Agent, or Firm*—Charles C. Corbin

[57] ABSTRACT

Disclosed is a swivelable binding plate assembly for a snowboard, including a generally circular base plate having a bottom directly supported on a snowboard, a top surface, an outwardly projecting perimeter edge spaced above the snowboard, and a central opening with a perimeter edge adapted to be engaged by the lower part of the outer edge of a hold-down disk received in the central opening, the disk being securable to the snowboard by threaded bolts to hold the base plate down to the snowboard and against rotation. A binding plate has an upper surface for releasably supporting a boot, a lower surface slidably supported on the base plate top surface, a central bore with smooth sloped edge walls that are slidably engaged by the upper part of the hold-down disk edge to hold down the central part of the binding plate relative to the base plate, and toe and heel portions of the binding plate each has an innwardly projecting lip that engages the underside of the base plate perimeter edge to hold the opposite ends of the binding plate against vertical movement relative to the base plate. The binding plate is swivelable through about 90°, and a handle-operated locking mechanism on the binding plate can releasably secure the binding plate at a given rotational position with respect to the base plate.

14 Claims, 3 Drawing Sheets

Fig. 3
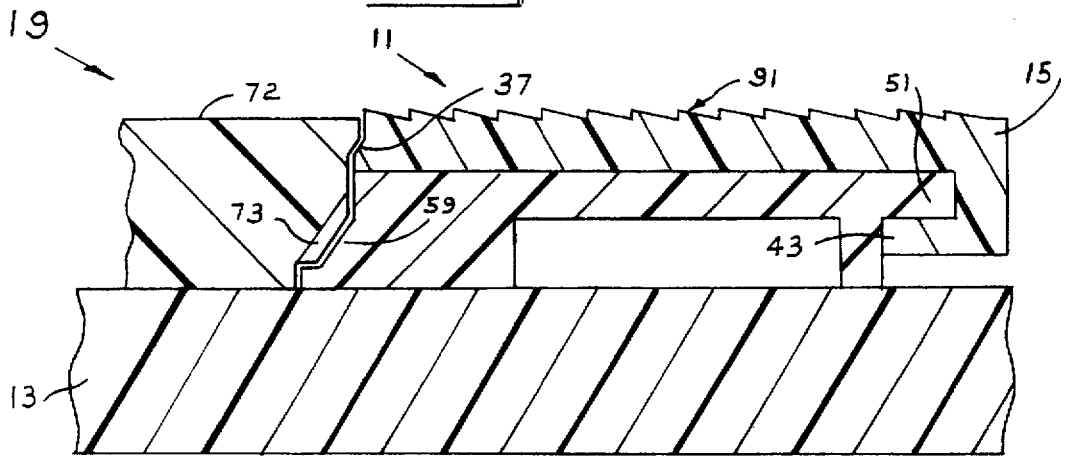
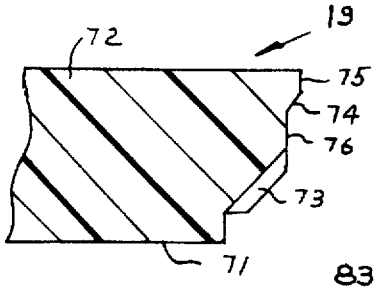
Fig. 5
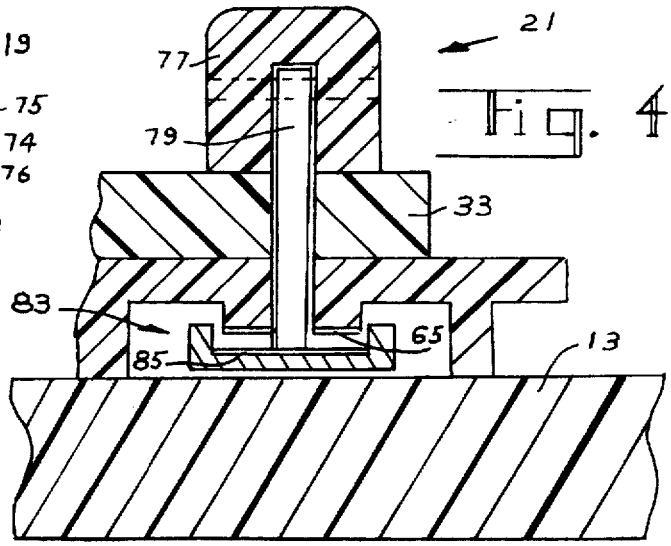
Fig. 4
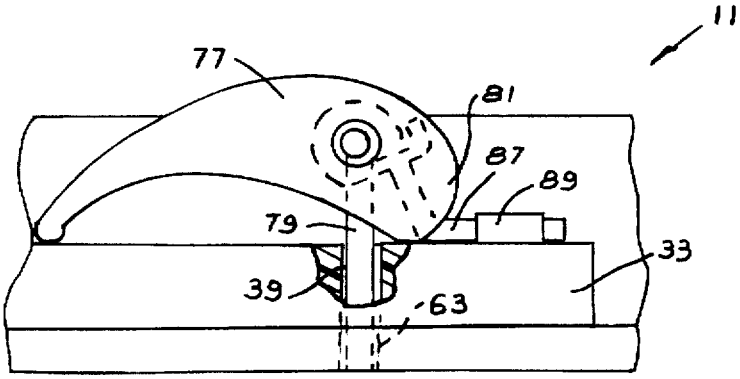
Fig. 6

SWIVELABLE BINDINGS MOUNT FOR A SNOWBOARD

BACKGROUND OF THE INVENTION

1. Field of the Invention

The present invention relates to binding systems for snowboards, and more particularly to a snowboard binding mount that allows swiveling of the binding plate for rapid angular adjustment relative to the centerline of the snowboard.

2. Description of the Prior Art

In recent years, there has been a tremendous growth of the sport of snowboarding, and concomitantly more attention has been given to some of the nagging problems experienced by snowboarders. A typical snowboard is essentially a single, wide ski that has fore and aft boot bindings that support both feet at a substantial angle with respect to the centerline of the snowboard. This cross-orientation of the bindings allows the rider to assume a side-forward stance, which is the necessary anatomical positioning for optimal in-use control of the snowboard. While this side-forward positioning is optimal for in-use control on the ski-run, it can result in problems for the snowboarder during non-snowboarding periods of use, such as when the snowboarder is maneuvering on flat terrain in the chairlift boarding area, and in maneuvering onto the lift chair and riding on the lift chair. Thus, it is a common and necessary practice for the snowboarder in such circumstances to disengage one boot, usually the aft boot, from its binding which allows the user to ride in what is termed "skate-board" style by propelling himself with his free foot. Problems result because the "skate-boarding" snowboarder who tries to assume a body-forward position during this time is compelled to hold his body in an unnatural and twisted position relative to the foot that is attached to the snowboard, which, besides being uncomfortable, exerts stress and strain on the knee joint which can damage the knee and aggravate existing knee problems. In addition, there is an increased chance that a snowboard rider will injure the stressed knee during an in-use fall.

Because a comfortable body-forward position is prevented, the ability to have optimum visibility to both sides of the path of travel, is greatly hindered. In addition, the problem of undue stress and strain on the snowboarder's leg and knee can be experienced by the snowboarder during his ride in the chairlift when he attempts to hold the attached snowboard, with one foot attached, in a manner that does not interfere with his chairlift companion.

One apparent solution to the problem is to provide means that will allow at least one of the bindings to be rotated from the normal transverse angular position to a toe-forward position relative to the snowboard, during non-snowboarding use of the snowboard by the user. In this regard, it is noted that the prior art does show some examples of snowboard binding support mechanisms that will allow angular adjustment of the binding with respect to the snowboard centerline. In U.S. Pat. No. 5,236,216, for example, there is shown a fastening disk that can be clamped upon a binding-support plate that can be turned about a normal axis to the board. Several bolts must be loosened somewhat to allow the rotational position of the binding plate to be changed, then the bolts must be re-tightened. Similarly, in U.S. Pat. No. 5,261,689, a number of bolts through a hold-down plate for a rotatable binding-support plate must be loosened and then re-tightened in order to change the binding orientation. The system shown in U.S. Pat. No. 5,044,654 is somewhat of an improvement since only a single central bolt must be loosened and re-tightened. While the aforementioned binding support systems have their advantages, they all share a major drawback in not allowing angular adjustment of bindings to be made quickly, easily, and conveniently, because they require removal of the boot from the binding in each case, and the use of tools to tighten and loosen the bolts.

U.S. Pat. No. 5,354,088 recognizes some of the unique problems to snowboarders; however, the aforestated problem is not addressed. Although it does disclose a mechanism that permits a swiveling motion of the bindings, this twisting motion is merely incidental to a rotation required for quickly uncoupling a boot binding from the snowboard to facilitate transition to a "skate-boarding" mode of travel.

It is also noted that it is often desirable to make fine adjustments to the angular displacement of fore and aft binding within their generally transverse orientations in order to suit the particular preferred stance of an individual snowboarder. In this regard, the prior art does provide means to accomplish this, as mentioned above, but as also mentioned above, such bolt-manipulating techniques are quite inadequate where speed, convenience, and ease are concerned.

U.S. Pat. No. 5,277,635 shows a water skiboard with rotatably adjustable bindings; however, it appears that such mechanism is not adequate for use in the snowboarding environment. It is also noted that the above-mentioned prior devices in their structure and design, do not lend themselves to relatively inexpensive, lightweight, low-profile, bindings mounts that are desirable by those enthusiasts who desire to enhance their snowboarding performance capabilities.

U.S. Pat. No. 5,499,837 shows an improved snowboard binding support with quick and effective swivelable adjustment capability; however, there remains a need for such a product that has unique structural features that will lend it to easy and efficient fabrication as well as having superior strength, durability, and reliability in the face of the high stresses encountered during normal rigorous use of a snowboard.

SUMMARY OF THE INVENTION

In view of the foregoing, it is a general object of the present invention to provide for a snowboarder, the capability of rapidly and easily changing the orientation of at least one of his feet from a transverse position to a toe-forward position, thereby enabling a natural position of the knee, foot, and leg during standing, walking, sitting, and "skate boarding".

Another object is to provide for a snowboarder, the capability of easily, quickly, and effectively, without disengaging one's feet from the snowboard, making fine adjustments to the angular orientation of the binding with respect to the centerline of the snowboard.

A related object is to provide snowboard users with substantially increased comfort and convenience during lift line and lift ride durations.

A still further object is to provide a way to substantially reduce the risk of harmful stress to the knee joints of snowboarders.

Yet another object is to provide a swivelable mount for a snowboard boot which has a very low vertical profile and is lightweight yet highly effective and reliable in its intended purpose.

An additional object is to provide a mount as mentioned above wherein the opposing toe and heel ends of the binding plate, as well as its central portion, are held firmly against movement away from the snowboard.

Yet a more particular object is to provide such a mount that lends itself to inexpensive injection molding techniques.

These and other objects and advantages are provided by the present invention of a swivelably adjustable boot binding mount for a snowboard, wherein the mount includes a generally circular base plate adapted to be stationarily affixed to the snowboard and having an upper surface and a lower surface, and a generally circular, outwardly projecting peripheral edge spaced above the level of said lower surface, and the central part of the base plate has a relatively large diameter bore that includes an annular, generally upwardly inclined portion characterized by a plurality of splines and/or spline-receiving sockets. A pair or diametrically opposed recesses lie along the peripheral edge of the base plate.

The mount further features a binding plate having an upper surface adapted for supporting a boot, a lower surface, an arcuate toe edge portion and an arcuate heel edge portion, each portion having an inwardly projecting lip spaced from the lower surface to provide an arcuate groove. There is a central opening in the binding plate that is concentric with the base plate bore and this opening has an edge that is smooth and generally upwardly inclined. The binding plate's opposite edge portions are receivable in the opposing recesses of the base plate peripheral edge, and when the binding plate is so-received, rotation about a central vertical axis allows the base plate edge to slidably engage the heel and toe grooves of the binding plate to hold the binding plate heel and toe portions against vertical movement relative to the base plate.

There is a hold-down disk adapted to be bolted to the snowboard, and its outer edge has a lower part with a plurality of sockets and/or splines for engaging the splines and/or sockets of the base plate to hold down the base plate and affix it at a selected rotational position relative to the centerline of the snowboard. The disk edge has an upper part with a smooth, generally downwardly inclined surface that slidably engages the smooth edge of the binding plate central opening to hold the central part of the binding plate against vertical separation from the base plate.

Finally, the mount includes locking means mounted on opposite sides of the binding plate for releasably locking the binding plate against rotation relative to the base plate.

In a preferred embodiment, there are first and second diametrically opposed arcuate slots in the base plate, concentric with its bore, and the locking means includes a pair of lever handles, each handle having a hub with a cam surface that slidably engages a top surface of the binding plate. A locking element is connected to the handle hub via a base plate arcuate slot, whereby rotation of the handle about a horizontal axis from an unlocked position to a locked position moves the locking head upwardly into binding engagement with an undersurface of the base plate.

The base plate arcuate slots each extend for about 90° of arc, and the unlocked binding plate can be readily swiveled from a transverse angular position to a toe-forward position, and vice versa, as desired, and then quickly relocked. Cylindrical portions of the hold-down disk edge slidably embrace parts of the binding plate central opening to guide rotation of the binding plate during these rotational changes. Of course, in either rotational position of the binding plate, its heel and toe, as well as central portion, remain firmly secured against upward separation.

It is contemplated that there are variants of the invention in which a locking head and connector arm are driven vertically by other drive mechanisms, such as handle rotatable about a vertical axis and with a bore that threadably engages the upper part of a connector arm.

In yet another preferred embodiment of the invention there is a bifurcated release strap with lower ends that attach respectively to the distal ends of the handles to allow these ends to be simultaneously pulled up, and operated by one hand to allow the snowboarder to make immediate, easy rotational adjustment of the bindings mount, both on and off the lift. The upper portion of the strap is provided with an adjustable loop that is engagable around the rider's leg. In this regard, it is noted that resort operators require, as a safety measure, a leash that connects the rider's leg to the snowboard, thus this inventive feature conveniently serves both as a safety leash and as a release device as described.

BRIEF DESCRIPTION OF THE DRAWINGS

FIG. 3 is an enlarged sectional view taken along the line 3—3 of FIG. 1;

FIG. 4 is an enlarged sectional view taken along the line 4—4 of FIG. 1;

FIG. 5 is an enlarged sectional view taken along the line 5—5 of FIG. 2; and

FIG. 6 is an enlarged partial side elevational view of a release handle.

DETAILED DESCRIPTION OF THE INVENTION

Figure 1:
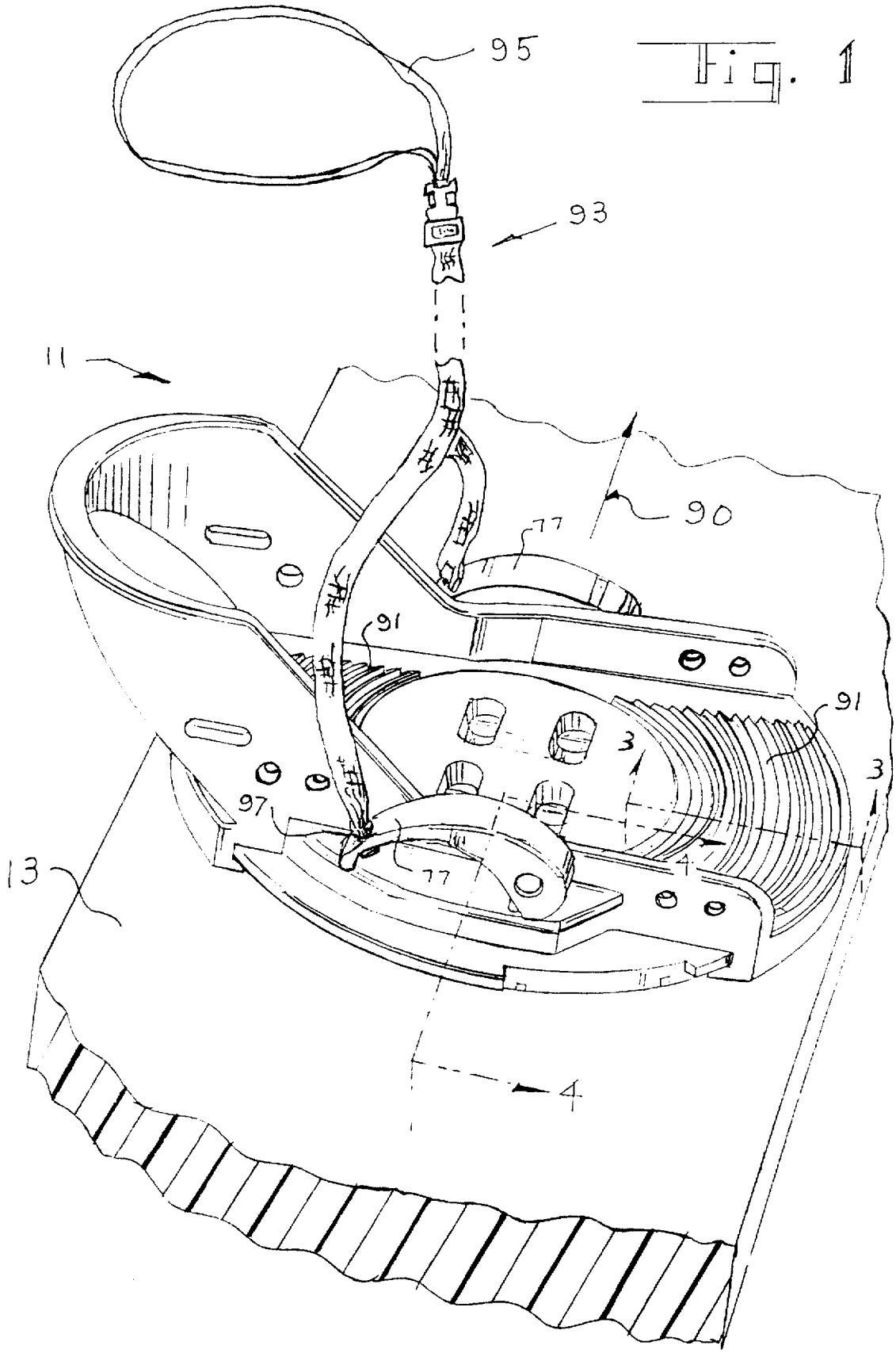
FIG. 1 is a perspective view of a preferred embodiment of a swivelable binding mount for a snowboard, according to the present invention.
Figure 2:
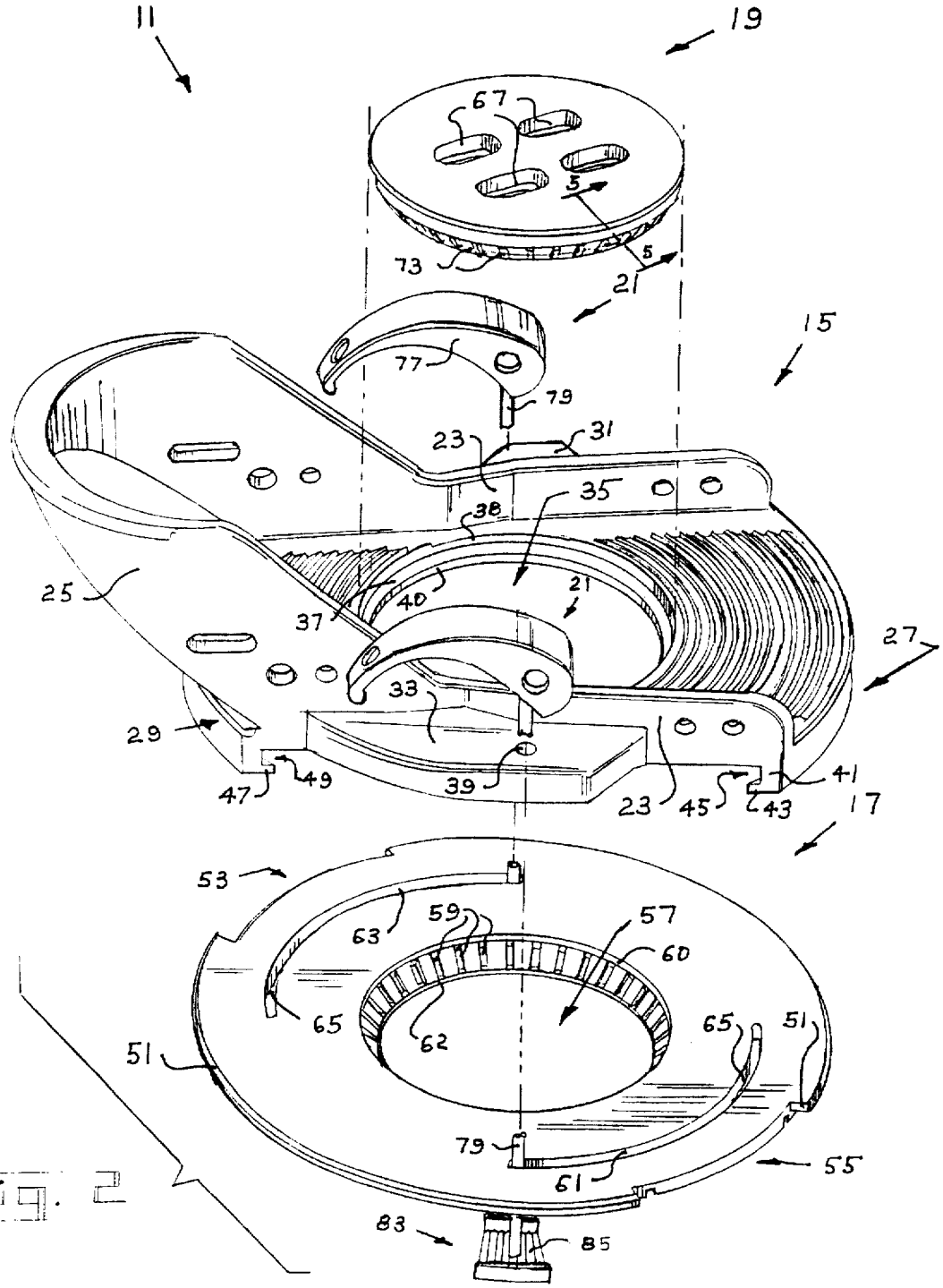
FIG. 2 is a perspective exploded view of the embodiment of FIG. 1.

Referring now to the drawings, FIG. 1 shows a preferred embodiment of a swivelable bindings mount 11 according to the present invention for a snowboard 13, and FIG. 2 shows that the main components of the mount include a swivelable binding plate 15, a base plate 17, a combination hold-down and rotation disk 19, and a pair of cam lever-operated locking mechanisms 21. The plates 15, 17 and 19 are preferably fabricated of a suitable, high-impact, high-strength plastic material using conventional injection molding techniques.

FIG. 2 shows that the opposing side walls 23 and a highback support 25 depend from the upper surface of binding plate 15, which plate has a toe edge portion 27, a heel edge portion 29, and opposite side flanges 31 and 33. The central portion of binding plate 15 is provided with a central bore 35 with a smooth sloped wall 37 and cylindrical surfaces 38 and 40. Vertical bores 39 are provided in the respective side flanges 31 and 33.

Note that the toe edge portion 27 of binding plate 15 includes a vertical web 41 and a lip 43 which provide an arcuate grove 45 concentric with central bore 35. Similarly, the heel edge portion has a lip 47 and an arcuate grove 49.

As shown in FIG. 2 the base plate 17 includes a circular outer edge 51 in which is provided a pair of diametrically opposed recesses 53 and 55 which are sized to receive the binding plate toe and heel portions 27 and 29 in a manner that will be described. A central bore 57 has a sloped wall characterized by a plurality of spline-receiving sockets 59. Cylindrical bore portions are shown at 60 and 62. Baseplate 17 also has first and second diametrically opposed slots 61 and 63 that are concentric with bore 57, and each extends for about 90° of arc. Adjacent the lower end of each slot 61 and 63 there is an array of downwardly projected ridges 65, shown partly in FIG. 2 and in greater detail in FIG. 4. There are lower surfaces (not shown) of the baseplate 17 that are designed to be engaged with the upper surface of the snowboard 13.

FIG. 2 also shows that the combination hold-down rotation disk 19 has elongate recessed holes 67 for receiving threaded fasteners for engaging threaded bores in the snowboard for anchoring disk 19 to the snowboard. As best shown in FIGS. 1, 3, and 5, the disk 19 has a bottom 71, a top 72, an edge that includes a sloped lower portion from which extend a number of splines 73 designed to engage the complementary spline-receiving sockets 59 on the base plate bore. The upper portion of the disk 19 edge features a smooth downwardly-inclined surface 74 intended for slidably engaging the binding plate opening in a retaining manner, to be described. Disk 19 also has cylindrical walls at 75 and 76 for guiding the rotation of binding plate 15.

The pair of locking mechanisms 21, as shown in FIGS. 2, 4, and 6, each include a handle 77 to which is hingedly connected the upper end of a connecting rod 79, and there is a cam surface 81 adapted to slidably engage the upper surface of flanges 31 and 33. Connecting rod 79 is slidably engagable through the bore 39, and a baseplate arcuate slot 61 or 63, and a locking head 83 is secured to the lower end of connecting rod 79. Locking head 83 is equipped with ridges 85 that are adapted to make releasable locking engagement with the downward-facing ridges 65 of the baseplate 17, when the locking mechanism is operated in a manner that will be described.

By viewing FIG. 2, it can be appreciated how, during assembly, the binding plate 15 is coupled to the baseplate 17 by aligning the two plates such that the toe and heel portions of the binding plate are engaged within the baseplate recesses 55 and 53, respectively. Then an anti-clockwise rotation of the binding plate will cause the outer edge 51 of the baseplate to snugly engage the arcuate grooves 45 and 49 of the binding plate so as to retain the heel and toe portions of the binding plate against vertical movement relative to the baseplate. FIG. 3 best illustrates the aforementioned connection.

FIGS. 1 and 2 show that knurled traction surfaces 91 are provided on the binding plate, and FIG. 3 best shows how surfaces 91 are at a higher elevation than the top surface 72 of the disk 19. This prevents undesirable interference of the bottom of the user's boot with surface 72 during rotation of the binding plate.

FIG. 4 is a sectional view through the assembled mount 11, mounted to snowboard 13, and best illustrates the unlocked position of the locking mechanism 21 wherein the handle 77 has been rotated from the locked position shown in FIG. 1 to lower the locking head 83 to disengage its ridges 85 from the ridges 65. In order to effectuate a rapid 90 degree change of orientation of the binding plate 11, the snowboarder merely has to flip each handle 77 from its locked position to the open position as illustrated in FIG. 4, rotate the binding plate through about 90 degrees, and then rotate the handles 77 back to their locked positions wherein the ridges 85 of the locking head 83 are clamped into engagement with opposing ridges 65. FIG. 6 shows how a coil spring 87, with one end secured to a side flange at 89, is used to bias handle 77 toward its locked position. A combination latch release strap and leg leash 93, shown in FIG. 1, is used to single-handedly operate handles 77. Its lower ends 95 are secured in openings in the distal ends of handles 77, and an adjustable loop portion 97 is engagable around the snowboarder's leg. Pulling upwards on strap 93 will simultaneously rotate handles 77 to their unlocked positions. By lowering strap 93, spring force will be allowed to rotate handles 77 immediately back to their locked positions.

In order to mount the assembled mount 11 to the snowboard 13, the disk 19 is installed within the bores 35 and 57 of the combined plates and then secured to the snowboard 13 with bolts 89 that engage threaded bores within the snowboard. Before the bolts 89 are tightened the baseplate 17 can be placed in a desired rotational position relative to the centerline 90 of the snowboard, then the bolts can be tightened and the splines 73 of the disk 19 engage the complementary baseplate splines 59 to clamp the baseplate 17 to the snowboard and to secure the baseplate in its rotational position. Note that the oblong disk holes 67 are aligned in the direction of centerline 90 to allow some adjustment to the spacing of one binding assembly to the other along centerline 90. As FIG. 5 shows, the smooth portion 74 of disk 19 will lie adjacent the smooth sloped wall 37 of the binding plate 15, which it slidably engages to hold down the binding plate. The cylindrical disk portions 75 and 76 slidably engage portions 38 and 40 of the binding plate opening wall to serve as a rotation hub for the binding plate.

While a particular preferred embodiment of the invention has been described, it is to be understood that various modifications and variations of the invention may occur to those experienced in the art, given the benefit of this disclosure. For example, one such variation would include a hold-down disk that has a splined baseplate-engaging surface and a smooth binding plate surface that are horizontal and downward-facing rather than sloped. Some variations in the locking mechanism are mentioned above. Thus, it is intended to cover all such changes and modifications as fall with the full scope and breadth of the invention as defined by the claims which follow.

What is claimed is:

1. A swivelable mount for the boot bindings for a snowboard, said mount being rotatably adjustable about an axis normal to said snowboard and including:

a. a baseplate having an upper surface, a lower surface adapted for directly engaging the upper surface of a snowboard, an outwardly projecting circular rim spaced at a level above said baseplate lower surface, said rim having first and second diametrically opposed recesses, a circular central bore in said baseplate and a plurality of upwardly-inclined splines and/or spline-receiving sockets adjacent to the periphery of said central bore;

b. a binding plate having a top surface adapted for releasably mounting a boot, an undersurface, a smooth-walled central opening concentric with said baseplate central bore, an edge of said opening including an annular upwardly-inclined surface, a heel portion and a toe portion, each said portion having an inwardly-racing arcuate groove, said binding plate underside adapted to engage the upper surface of said baseplate and the heel and toe portions of said binding plate adapted to be received respectively in the first and second recesses of the baseplate rim, whereby the rim is engagable in said grooves to retain said binding plate against vertical movement relative to said baseplate;

c. a hold-down disk having an upper surface and a lower surface, and an outer edge portion, a lower part of said edge portion adapted to make locking engagement with the splines and/or spline-receiving sockets of said base plate, and an upper part of said edge portion adapted to slidably engage said binding plate opening edge to retain said binding plate against upward movement relative to said base plate, and to mount the binding plate for rotation; and d. locking means mounted on said binding plate for engaging said baseplate to releasably hold said binding plate against rotation relative to said baseplate, wherein in its released condition said binding plate can be rotated through at least 90°.

2. A mount as defined in claim 1 wherein said disk edge lower part is downwardly sloped and has splines and/or spline-receiving sockets complementary to the splines and/or sockets of said base plate.

3. A mount as defined in claim 1 wherein said disk edge upper part includes an annular surface inclined at a complementary angle to the annular surface of said binding plate opening edge.

4. A mount as defined in claim 3 wherein said disk edge upper part includes cylindrical surfaces for rotatably mounting said binding plate.

5. A mount as defined in claim 4 wherein said disk edge lower part is sloped at a substantial angle to the horizontal.

6. A mount as defined in claim 1 wherein said disk edge lower edge portion is generally horizontal.

7. A mount as defined in claim 1 wherein said disk edge upper part includes an annular portion in a horizontal plane.

8. A mount as defined in claim 1 wherein there are first and second diametrically opposed arcuate slots in said base plate, concentric with said bore, and said locking means includes a rotatable handle mounted on each of the opposite sides of said binding plate, said handle having a distal end and a hub end, a connector disposed through one of said arcuate slots and a locking head connected to a lower end of said connector and disposed opposite to a downwardly-facing brake surface of said base plate, whereby an upper end of said connector is connected in vertical drive relationship with the hub end of said handle, said handle having an unlocked position in which the locking head is spaced from said brake surface and being rotatable to a locked position to draw the locking head in binding engagement with said brake surface.

9. A mount as defined in claim 8 wherein said arcuate slots extend for about 90° of arc.

10. A mount as defined in claim 8 wherein said handle rotates about a horizontal axis.

11. A mount as defined in claim 10 wherein said connector pivotally connects to said handle hub end and said hub has a cam surface that engages an upper surface of said binding plate.

12. A mount as defined in claim 8 wherein said hub end threadedly engages said connector and rotates about a vertical axis.

13. A mount as defined in claim 8 including spring means for biasing said handle in its locked position.

14. A mount as defined in claim 1 wherein said locking means includes a rotatable handle mounted on each of the opposite sides of said binding plate, said handle having a distal end and being rotatable about a horizontal axis from a generally horizontal locked position to which it is biased by spring means, and a handle release means having a bifurcated lower portion secured to the distal ends of said handles and an upper portion adapted to be attached to the leg of a user of said snowboard.

* * * * *